US007448889B1

(12) United States Patent
Ho et al.

(10) Patent No.: US 7,448,889 B1
(45) Date of Patent: Nov. 11, 2008

(54) MEMORY CARD CONNECTOR

(75) Inventors: Hsin-tsung Ho, Tu-Cheng (TW); Chung-yu Chen, Tu-Cheng (TW); Mei-chuan Yang, Tu-Cheng (TW); Chung-hsin Huang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/797,662

(22) Filed: May 7, 2007

(51) Int. Cl.
*H01R 13/62* (2006.01)

(52) U.S. Cl. ..... 439/159; 439/630

(58) Field of Classification Search ..... 439/159, 439/160, 161, 162, 630
See application file for complete search history.

(56) References Cited

U.S. PATENT DOCUMENTS 6,669,493 B2 * 12/2003 Kuroda ..... 439/159
6,951,471 B1 * 10/2005 Chen ..... 439/159
7,018,222 B2 * 3/2006 Chang ..... 439/159
7,056,153 B2 * 6/2006 Watanabe et al. ..... 439/630
7,070,430 B2 * 7/2006 Yang et al. ..... 439/159
7,322,839 B1 * 1/2008 Wu et al. ..... 439/159

* cited by examiner

*Primary Examiner*—Neil Abrams
*Assistant Examiner*—Phuong Nguyen
(74) *Attorney, Agent, or Firm*—Rosenberg, Klein & Lee

(57) ABSTRACT

A memory card connector includes an insulating housing, an auxiliary member and an ejecting device used for withdrawing a memory card from the memory card connector. The insulating housing has a base. Two sidewalls and a rear wall extend upwards from edges of the base. A plurality of terminal cavities are defined in the insulating housing for receiving a plurality of electric terminals. A cover is coupled with the insulating housing. One side of the insulating housing defines an accommodating cavity. A preventing member is formed at the inside of the accommodating cavity. The auxiliary member is received in the accommodating cavity and slides between the sidewall and the preventing member. The auxiliary member includes at least one elastic member and a cooperative member. The elastic member is located between and against the sidewall and the cooperative member. Hence, the cooperative member is blocked by the preventing member.

8 Claims, 5 Drawing Sheets

MEMORY CARD CONNECTOR

BACKGROUND OF THE INVENTION

1. Field of the Invention

This present invention relates to a memory card connector, and more particularly to a memory card connector capable of receiving two different types of memory cards.

2. The Related Art

Memory card such as Memory Stick Duo card, SD card, Mini SD card, MMC card, MMC 4.0 card, RS MMS 4.0 card, etc. is a kind of record medium used in the video camera, digital camera, mobile phone and other electronic devices. There are many different types of memory cards that differ in shape and size. In order to receive two different types of memory cards in an electronic device respectively, a memory card connector capable of receiving two types of memory cards is required.

Conventionally, a memory card connector receiving two types of memory cards includes a housing and a shell. Two groups of receiving slots are formed inside the housing. One group of the receiving slots is formed at the upper place of the housing, and the other group of the receiving slots is formed at the lower place of the housing. Two groups of terminals are located inside the two groups of the receiving slots respectively. Two memory cards that are different in type are received respectively in the two groups of the receiving slots.

However, the two groups of the receiving slots are superimposed inside the housing to receive two different types of memory cards. Therefore the height of the memory card connector is increased, and the memory card connector occupies a large space of the housing.

SUMMARY OF THE INVENTION

Accordingly, an object of the present invention is to provide a memory card connector for receiving two different types of memory cards. The memory card connector includes an insulating housing, an auxiliary member and an ejecting device. The insulating housing has a base, two sidewalls extending upwards from both sides of the base, and a rear wall extending upwards from the rear end of the base. The two sidewalls and the rear wall define a chamber therebetween. A plurality of terminal cavities are defined in the insulating housing for respectively receiving a plurality of electric terminals. A cover is coupled with the insulating housing. The left side of the insulating housing defines an accommodating cavity. A preventing member is formed at the inside of the accommodating cavity. The other side of the insulating housing defines a sliding recess. The auxiliary member is received in the accommodating cavity and slides between the sidewall and the preventing member. The auxiliary member includes at least one elastic member and a cooperative member. The inner surface of the cooperative member is used as a contacting portion. The elastic member is located between and against the sidewall and the cooperative member. Hence, the cooperative member is blocked by the preventing member. The ejecting device is received in the sliding recess and used for withdrawing the memory card from the memory card connector.

As described above, while the memory card is inserted in the memory card connector, the cooperative member of the auxiliary member presses one side of the memory card to make the other side of the memory card stay close to the ejecting device. Then the memory card can be inserted or extracted from the memory card connector steadily. So different types of memory cards can be inserted in the same memory card connector because of the auxiliary member. At the same time, the structure of the memory card connector with the auxiliary member is compact and the height of the memory card connector is reduced.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
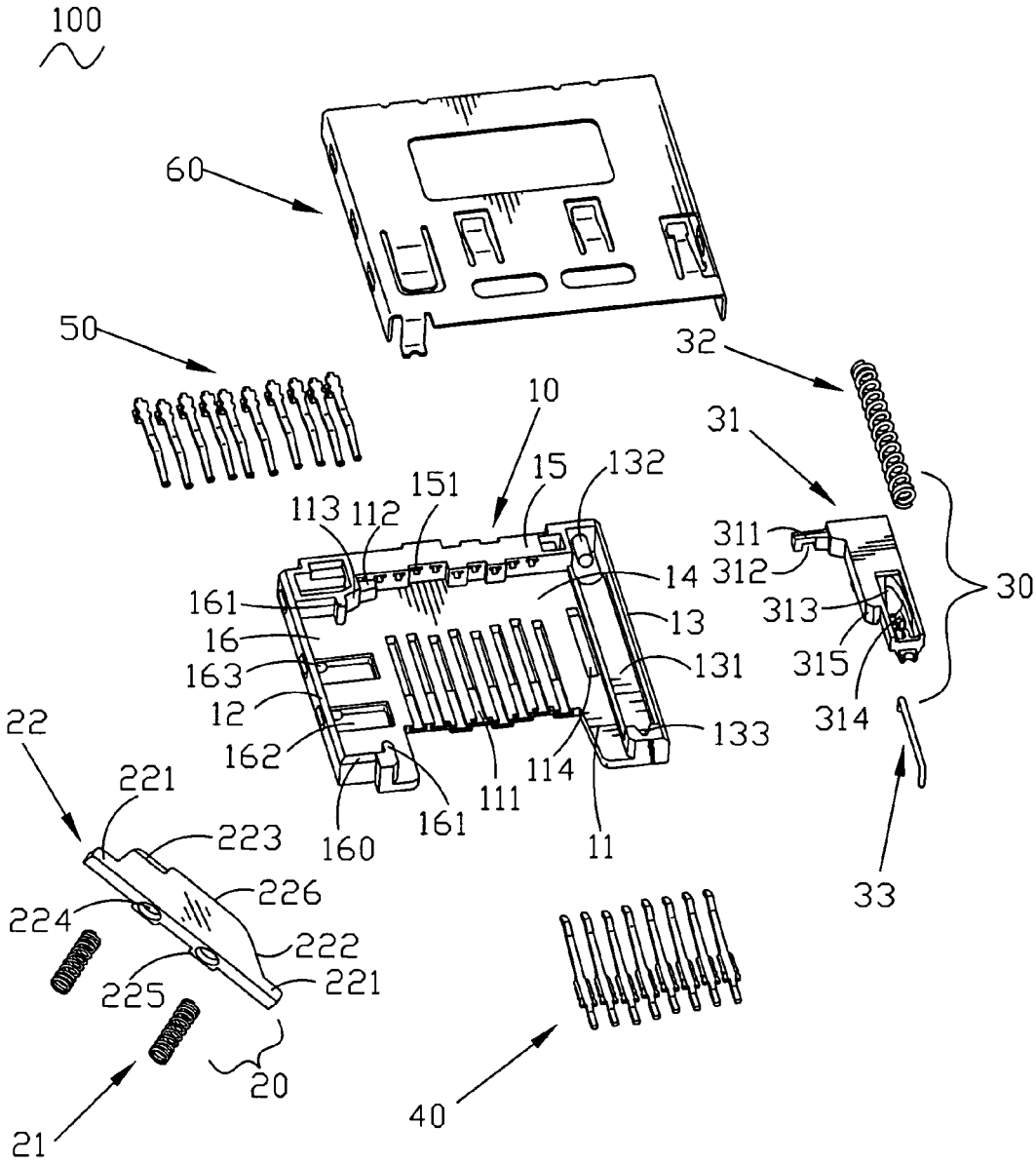
FIG. 1 is an exploded view of a memory card connector of the present invention.

Please refer to FIG. 1. A memory card connector 100 includes an insulating housing 10, an auxiliary member 20, an ejecting device 30, a plurality of first electric terminals 40, a plurality of second electric terminals 50 and a cover 60.

The insulating housing 10 includes a base 11. Two parallel sidewalls (12,13) extend upwards from the left and the right sides of the base 11. A rear wall 15 extends upwards from the rear end of the base 11. The two sidewalls (12,13) and the rear wall 15 define a chamber 14 therebetween for receiving an external memory card. A plurality of first terminal cavities 111 are defined longitudinally in the front of the base 11. The base 11 protrudes upward to form a first blocking portion 112 at the back. A plurality of second terminal cavities 151 are defined in the rear wall 15 and penetrate through the rear wall 15.

The insulating housing 10 defines an accommodating cavity 16 to receive the auxiliary member 20 at left side. The accommodating cavity 16 is surrounded by the left sidewall 12, the rear wall 15, a front wall 160, and a pair of preventing walls 161. The front wall 160 extends inward from the front of the left sidewall 12. The inner end of the front wall 160 extends backward to form one of the preventing walls 161. The other preventing wall 161 extends forward from the left of the rear wall 15 and faces to the preventing wall 161 at the front. A second blocking portion 113 is formed between the first blocking portion 112 and the preventing wall 161 at the back. A pair of guiding cavities 162 are defined transversely in the left of the base 11 and located at the front and rear respectively. One end of the guiding cavity 162 connects with the left sidewall 12. The left sidewall 12 protrudes inward at the places facing to the guiding cavities 162 to form a pair of locating rods 163.

The insulating housing 10 receives the ejecting device 30 at right side. The right sidewall 13 defines a longitudinal sliding recess 131. The sliding recess 131 communicates with the chamber 14. The rear wall of the sliding recess 131 protrudes forward to form a retaining rod 132 locating in the sliding recess 131. The front wall of the sliding recess 131 defines a stepped locating hole 133. Next to the sliding recess 131, the base 11 of the insulating housing 10 defines a longitudinal fixing cavity 114 parallel with the sliding recess 131.

Figure 2:
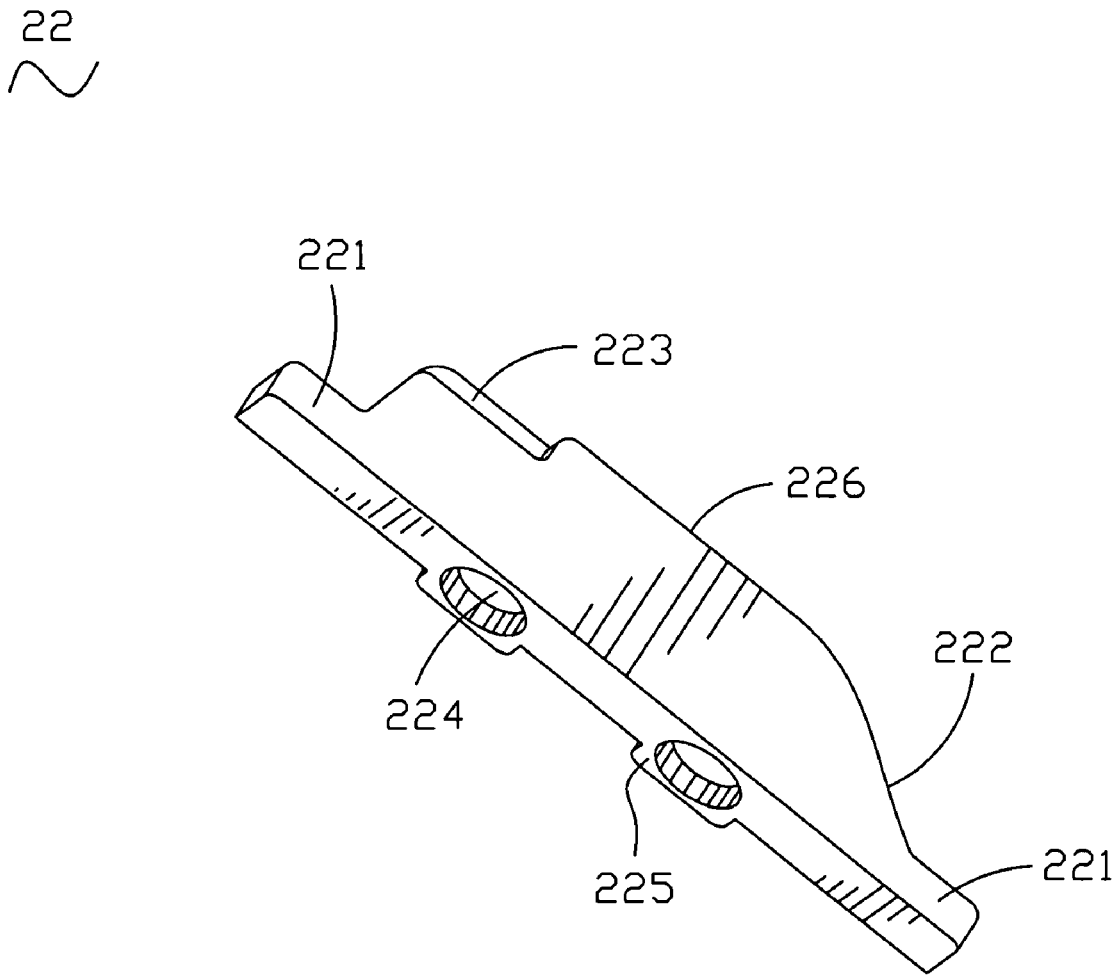
FIG. 2 is a perspective view of a cooperative member of the memory card connector.

Please refer to FIGS. 1-2. The auxiliary member 20 includes a pair of elastic members 21 and a cooperative member 22. The cooperative member 22 extends longitudinally. Both ends of the cooperative member 22 extend toward the front and rear to form a pair of resisting portions 221 at the left. The front resisting portion 221 connects with the inner surface of the cooperative member 22 used as a contacting portion 226 by a smooth cambered surface 222. The rear end of the cooperative member 22 defines a gap 223 at the right edge. The cooperative member 22 extends downward to form a pair of transverse beams 225 locating at the front and rear respectively. A pair of transverse containing chambers 224 is defined in the cooperative member 22. The containing chamber 224 communicates with the outside at the left. The place of the containing chamber 224 is corresponding to the beam 225.

Please refer to FIG. 1 again. The ejecting device 30 includes a sliding body 31, a spring 32 and a connecting bar 33. The sliding body 31 is L-shaped, which includes a longitudinal portion and a transverse portion that extends inward from the back end of the longitudinal portion. The transverse portion is used as a first pushing portion 311. The first pushing portion 311 defines an opening 312 at the bottom, and therefore the first pushing portion 311 will not touch the first electric terminals 40 in the process of sliding. The sliding body 31 defines a trace cavity 313 at the front of the longitudinal portion. An inclining shoulder 314 is defined in the trace cavity 313. The front end of the longitudinal portion of the sliding body 31 is cut off at the left to form a second pushing portion 315.

Figure 3:
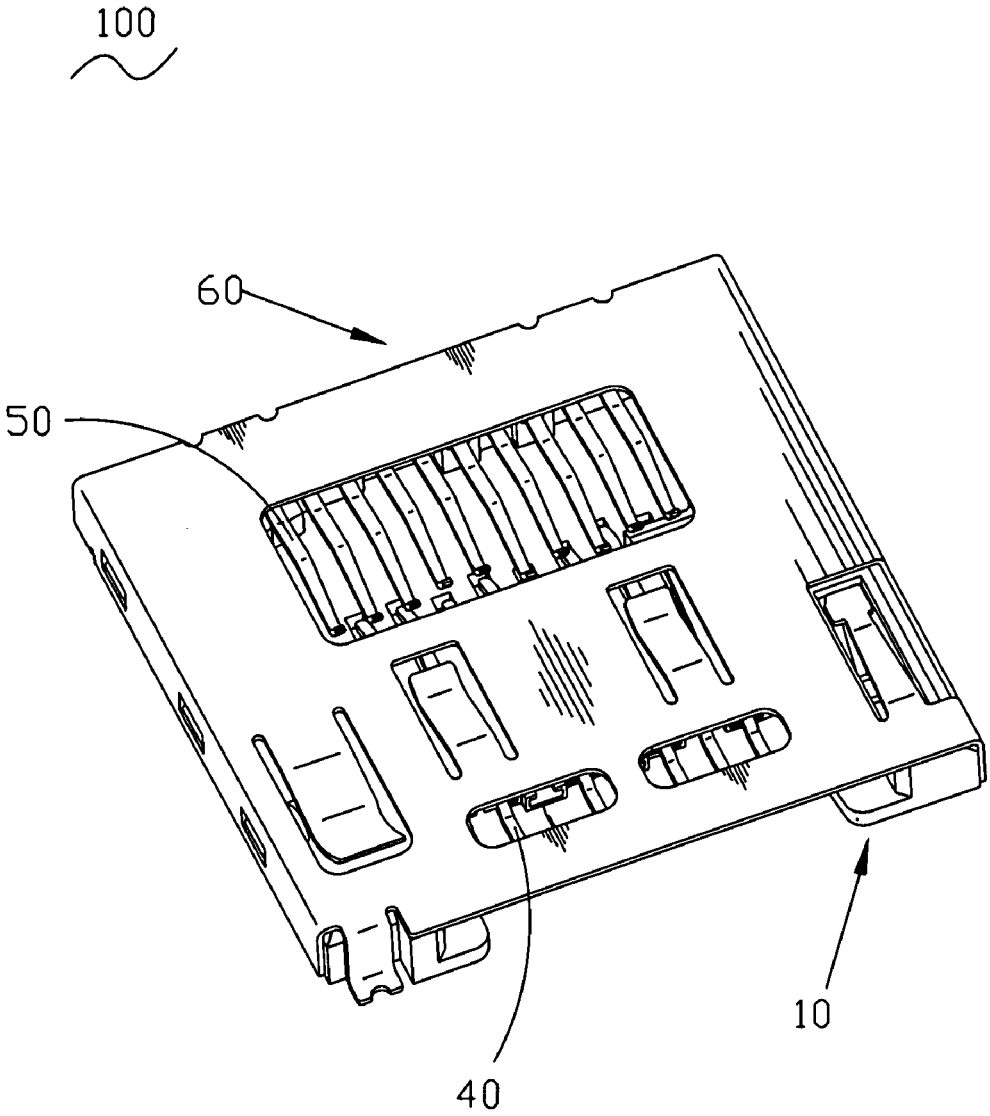
FIG. 3 is a perspective view of the memory card connector in accordance with the present invention.

Please refer to FIGS. 1-3. In assembly, the first electric terminals 40 are located in the first terminal cavities 111 and the second electric terminals 50 are arranged in the second terminal cavities 151 respectively. The combination of the auxiliary member 20 is received in the accommodating cavity 16 of the insulating housing 10. Correspondingly, the cooperative member 22 is placed in the accommodating cavity 16 of the insulating housing 10 with the beams 225 slidingly received in the corresponding guiding cavities 162. The gap 223 receives a part of the second electric terminals 50. One end of the elastic member 21 is inserted in the locating rod 163 and the other end of the elastic member 21 is inserted in the containing chamber 224, and then drives the resisting portions 221 to contact with the preventing walls 161 of the accommodating cavity 16. The ejecting device 30 is assembled in the right side of the insulating housing 10. The sliding body 31 is received in the sliding recess 131 and the fixing cavity 114. One end of the spring 32 is inserted in the retaining rod 132 and the other end is against the rear end of the sliding body 31. The front end of the connecting bar 33 is arranged in the locating hole 133 and the back end is arranged in the trace cavity 313 of the sliding body 31. The cover 60 is coupled with the insulating housing 10.

Figure 4:
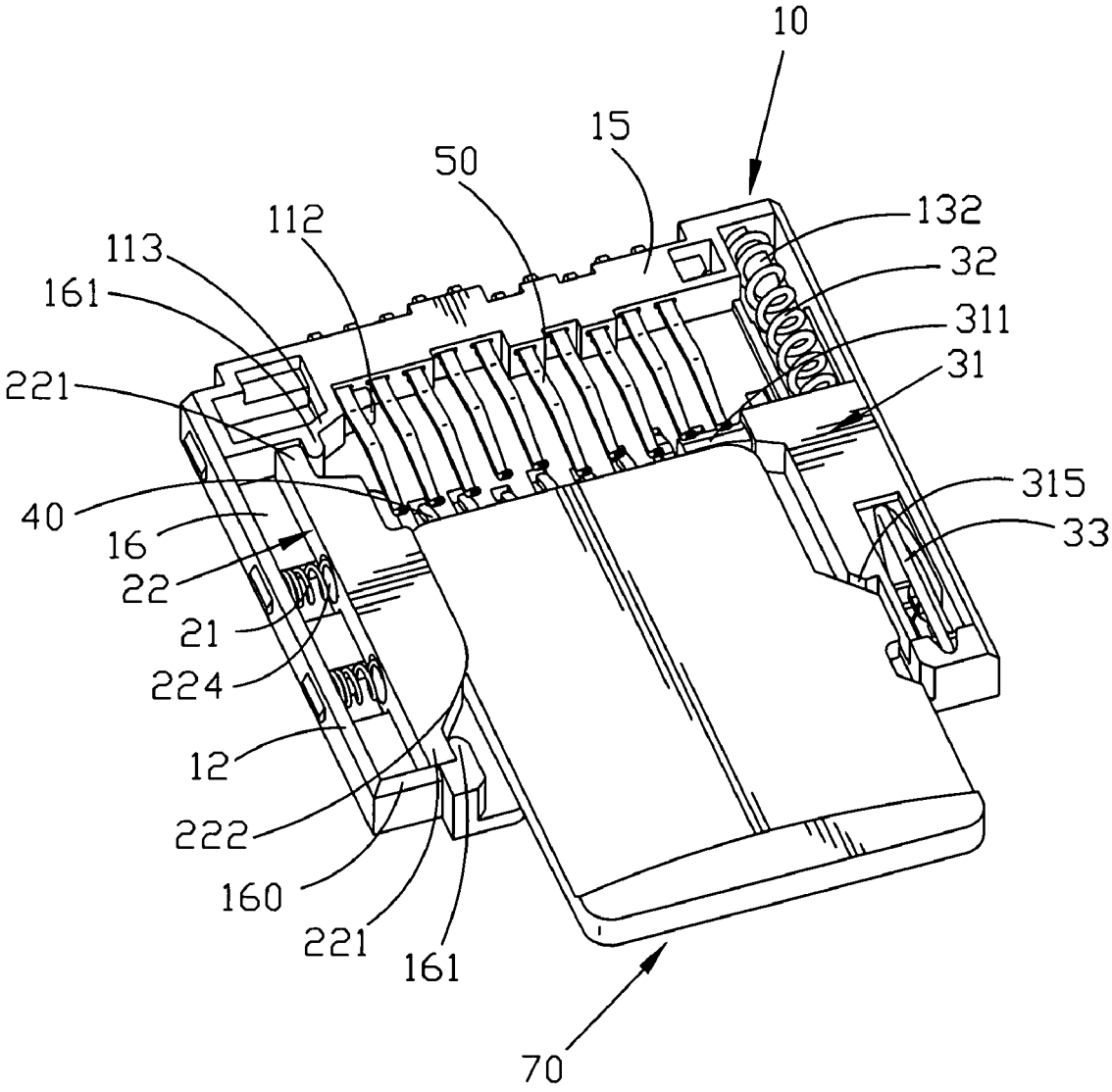
FIG. 4 is a perspective view of the memory card connector without a cover, in which a first memory card is inserted.

Referring to FIG. 4, when a Micro SD card as a first memory card 70 is inserted in the memory card connector 100 along the smooth cambered surface 222 of the cooperative member 22 and makes the cooperative member 22 move outward in the accommodating cavity 16, then the elastic member 21 is compressed and provides a pushing force to the cooperative member 22. Therefore, the contacting portion 226 presses the left of the first memory card 70 to make the right of the first memory card 70 stay close to the ejecting device 30. The movement of the first memory card 70 drives the sliding body 31 of the ejecting device 30 slide along the sliding recess 131 and the fixing cavity 114 of the insulating housing 10 by pushing the pushing portion 311, 315. Then the spring 32 is compressed and the back end of the connecting bar 33 slides along the trace cavity 313. The electric module of the first memory card 70 just contacts with the first electric terminals 40 when the back end of the connecting bar 33 is blocked by the shoulder 314 of the trace cavity 313. Because of the compression of the auxiliary member 20, the first memory card 70 is located between the auxiliary member 20 and the ejecting device 30 steadily.

Figure 5:
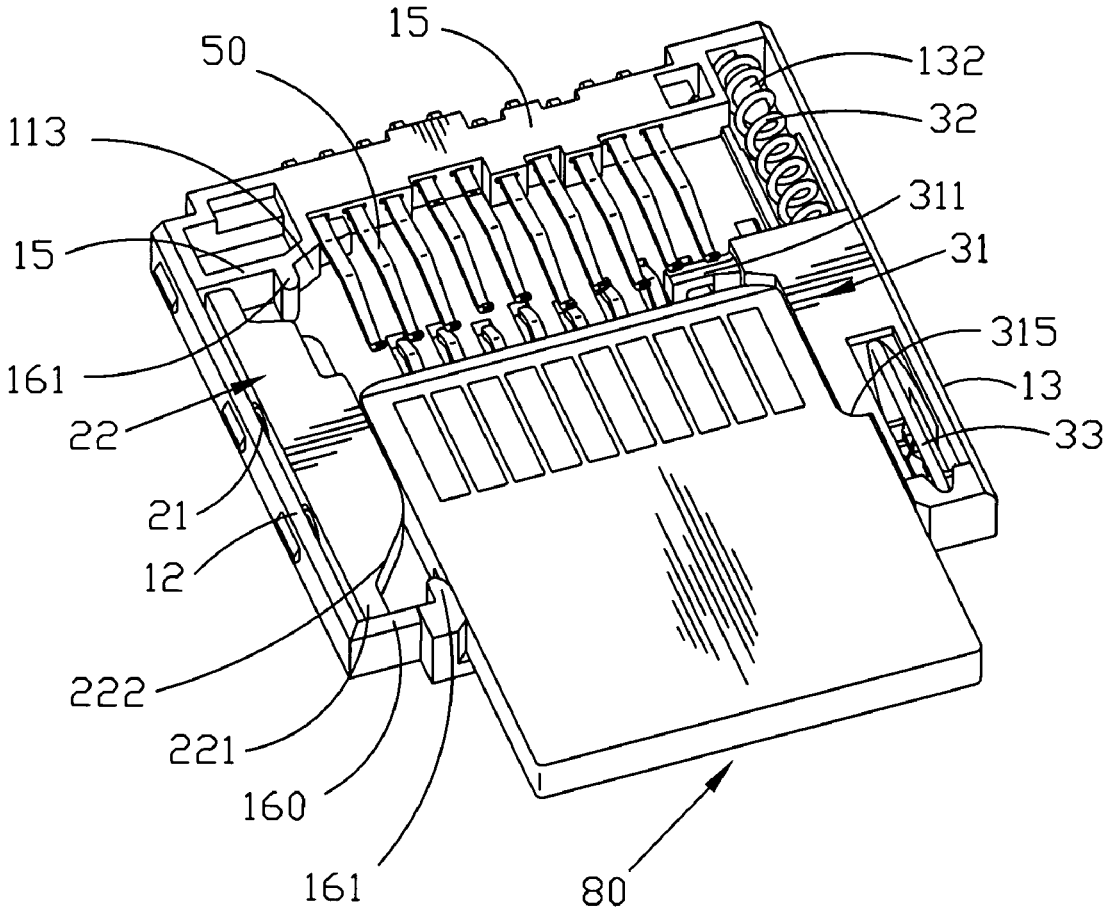
FIG. 5 is a perspective view of the memory card connector without the cover, in which a second memory card is inserted.

Please refer to FIG. 5. When a MMC Micro card as a second memory card 80 is inserted in the memory card connector 100 along the smooth cambered surface 222 of the cooperative member 22 and makes the cooperative member 22 move outward in the accommodating cavity 16, then the elastic member 21 is compressed and provides a pushing force to the cooperative member 22. Therefore, the cooperative member 22 presses the left of the second memory card 80 to make the right of the second memory card 80 stay close to the ejecting device 30. The movement of the second memory card 80 drives the sliding body 31 of the ejecting device 30 slide along the sliding recess 131 and the fixing cavity 114 of the insulating housing 10 by pushing the pushing portion 311, 315. Then the spring 32 is compressed and the back end of the connecting bar 33 slides along the trace cavity 313. The electric module of the second memory card 80 just contacts with the second electric terminals 50 when the back end of the connecting bar 33 is blocked by the shoulder 314 of the trace cavity 313. Because of the compression of the auxiliary member 20, the second memory card 80 is located between the cooperative member 20 and the ejecting device 30 steadily.

When the memory card is about to be taken out from the memory card connector 100, the memory card obtains a push force towards the back again until the memory card resists against the second blocking portion 113 or the first blocking portion 112. The back end of the connecting bar 33 removes out of the shoulder 314 and slips into the trace cavity 313. At the same time, the power stored in the spring 32 releases and the spring 32 stretches forwards. The spring 32 pushes the sliding body 31 moving forwards. The memory card is taken out of the memory card connector 100. Meanwhile, the cooperative member 22 slides inwards under the push of the elastic member 21 until the resisting portions 221 are against the preventing walls 161.

As described above, while a memory card is inserted in the memory card connector 100, the cooperative member 22 of the auxiliary member 20 presses one side of the memory card to make the other side of the memory card stay close to the ejecting device 30. Then the memory card can be inserted or extracted from the memory card connector 100 steadily. So the different types of memory cards can be inserted in the same memory card connector 100 because of the auxiliary member 20. At the same time, the structure of the memory card connector 100 with the auxiliary member 20 is compact and the height of the memory card connector 100 is reduced.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A memory card connector, comprising:

an insulating housing, including a base, two sidewalls extending upwards from both sides of the base, and a rear wall extending upwards from the rear end of the base, the two sidewalls and the rear wall defining a chamber therebetween, a plurality of terminal cavities defined in the insulating housing, the left side of the insulating housing defining an accommodating cavity, a preventing member formed at the inside of the accommodating cavity, the other side of the insulating housing defining a sliding recess;

an auxiliary member received in the accommodating cavity and sliding between the sidewall and the preventing member, including at least one elastic member and a cooperative member, the inner surface of the cooperative member used as a contacting portion adapted for abutting a memory card, the elastic member located between the sidewall and an outer surface of the cooperative member opposite to the contacting portion and configured to be elastically abutting the outer surface of the cooperative member and further to firmly hold the contacting portion against a memory card, the cooperative member being blocked by the preventing member;

an ejecting device received in the sliding recess and used for withdrawing a memory card from the memory card connector;

a plurality of electric terminals, received in the respective terminal cavities; and a cover, coupled with the insulating housing.

2. A memory card connector, comprising:

an insulating housing, including a base, two sidewalls extending upwards from both sides of the base, and a rear wall extending upwards from the rear end of the base, the two sidewalls and the rear wall defining a chamber therebetween, a plurality of terminal cavities defined in the insulating housing, the left side of the insulating housing defining an accommodating cavity, a preventing member formed at the inside of the accommodating cavity, the other side of the insulating housing defining a sliding recess;

an auxiliary member received in the accommodating cavity and sliding between the sidewall and the preventing member, including at least one elastic member and a cooperative member, the inner surface of the cooperative member used as a contacting portion, the elastic member located between and against the sidewall and the cooperative member, the cooperative member blocked by the preventing member;

an ejecting device received in the sliding recess and used for withdrawing a memory card from the memory card connector;

a plurality of electric terminals, received in the respective terminal cavities; and a cover, coupled with the insulating housing;

wherein the preventing member includes two preventing walls, a front wall extends from the front of the sidewall at the left, one of the preventing walls extends backward from the inner end of the front wall, and the other preventing wall extends forward from the left side of the rear wall and faces to the preventing wall at the front, both ends of the cooperative member extending toward the front and rear to form a pair of resisting portions, the resisting portions are against the preventing walls respectively.

3. The memory card connector as claimed in claim 2, wherein the resisting portion at the front connects with the contacting portion by a smooth cambered surface.

4. A memory card connector, comprising:

an insulating housing, including a base, two sidewalls extending upwards from both sides of the base, and a rear wall extending upwards from the rear end of the base, the two sidewalls and the rear wall defining a chamber therebetween, a plurality of terminal cavities defined in the insulating housing, the left side of the insulating housing defining an accommodating cavity, a preventing member formed at the inside of the accommodating cavity, the other side of the insulating housing defining a sliding recess;

an auxiliary member received in the accommodating cavity and sliding between the sidewall and the preventing member, including at least one elastic member and a cooperative member, the inner surface of the cooperative member used as a contacting portion, the elastic member located between and against the sidewall and the cooperative member, the cooperative member blocked by the preventing member;

an ejecting device received in the sliding recess and used for withdrawing a memory card from the memory card connector;

a plurality of electric terminals, received in the respective terminal cavities; and a cover, coupled with the insulating housing;

wherein the bottom of the cooperative member extends downward to form a plurality of transverse beams locating at the front and rear respectively, the accommodating cavity defining a plurality of transverse guiding cavities at the front and rear respectively, the beam slidingly received in the guiding cavity.

5. The memory card connector as claimed in claim 4, wherein the sidewall at the left protrudes inward to form a plurality of locating rods, a plurality of containing chambers defined in the cooperative member, one end of the elastic member inserted in the locating rod and the other end of the elastic member is inserted in the containing chamber.

6. The memory card connector as claimed in claim 5, wherein the auxiliary member includes two elastic members, correspondingly, the cooperative member defines two containing chambers.

7. The memory card connector as claimed in claim 4, wherein the accommodating cavity defines two guiding cavities, correspondingly, the cooperative member has two beams.

8. The memory card connector as claimed in claim 7, wherein the plurality of the electric terminals are divided into two groups, the two groups electric terminals received in the insulating housing respectively for receiving two different types of memory cards.

* * * * *